US010788787B2

(12) United States Patent
Yokoi

(10) Patent No.: US 10,788,787 B2
(45) **Date of Patent: *Sep. 29, 2020**

(54) DEVELOPING CARTRIDGE INCLUDING HOLDER MOVABLY SUPPORTING ELECTRICAL CONTACT SURFACE

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/737,395

(22) Filed: Jan. 8, 2020

(65) Prior Publication Data

US 2020/0142352 A1 May 7, 2020

Related U.S. Application Data

(63) Continuation of application No. 16/225,706, filed on Dec. 19, 2018, now Pat. No. 10,534,312.

(30) Foreign Application Priority Data

Feb. 23, 2018 (JP) ..... 2018-030236

(51) Int. Cl.

| | |
|---|---|
| ***G03G 21/16*** | (2006.01) |
| ***G03G 21/18*** | (2006.01) |
| ***G03G 15/08*** | (2006.01) |

(52) U.S. Cl.

CPC ..... *G03G 21/1676* (2013.01); *G03G 15/0806* (2013.01); *G03G 15/0863* (2013.01); *G03G 21/1647* (2013.01); *G03G 21/1871* (2013.01); *G03G 21/1821* (2013.01); *G03G 2221/183* (2013.01)

(58) Field of Classification Search

CPC ..... G03G 21/1647; G03G 21/1676; G03G 21/1852; G03G 21/1821; G03G 21/1867; G03G 21/1871; G03G 2221/163; G03G 2221/166; G03G 2221/183; G03G 15/0863; G03G 15/0806

See application file for complete search history.

(56) References Cited

U.S. PATENT DOCUMENTS

| | | | | |
|---|---|---|---|---|
| 10,534,312 | B2 * | 1/2020 | Yokoi ..... | G03G 21/1676 |
| 2008/0199204 | A1 | 8/2008 | Ishii et al. | |
| 2011/0129252 | A1 | 6/2011 | Oda et al. | |
| 2013/0051849 | A1 | 2/2013 | Itabashi et al. | |
| 2016/0349699 | A1 | 12/2016 | Miyamoto et al. | |

FOREIGN PATENT DOCUMENTS

| | | | |
|---|---|---|---|
| JP | 2013-54058 | A | 3/2013 |

* cited by examiner

*Primary Examiner* — Sophia S Chen
(74) *Attorney, Agent, or Firm* — Merchant & Gould P.C.

(57) ABSTRACT

A developing cartridge includes: a housing extending in a first direction; a developing roller; a memory held at the housing; a holder holding an electrical contact surface; and a relay component electrically connecting the memory to the electrical contact surface. The developing roller is rotatable about an axis extending in the first direction. The developing roller is positioned at one end portion of the housing in a second direction. The holder is movable relative to the housing in at least one of the second direction and a third direction crossing the first direction and the second direction. The third direction also crosses the electrical contact surface.

7 Claims, 11 Drawing Sheets

DEVELOPING CARTRIDGE INCLUDING HOLDER MOVABLY SUPPORTING ELECTRICAL CONTACT SURFACE

CROSS REFERENCE TO RELATED APPLICATION

This application is a Continuation of U.S. patent application Ser. No. 16/225,706, filed Dec. 19, 2018, which claims priority from Japanese Patent Application No. 2018-030236 filed Feb. 23, 2018. The entire content of the priority applications are incorporated herein by reference.

TECHNICAL FIELD

The present disclosure relates to a developing cartridge.

BACKGROUND

Conventionally, electrophotographic image-forming apparatuses such as laser printers and LED printers are well-known. Such image-forming apparatuses include developing cartridges. Each developing cartridge includes a developing roller for supplying a developing agent.

According to the conventional image-forming apparatus, a developing cartridge is attachable to a corresponding drum cartridge including a photosensitive drum. When the developing cartridge is attached to the corresponding drum cartridge, a developing roller of the developing cartridge comes into contact with the photosensitive drum. The drum cartridge having the developing cartridge attached thereto is then attached to the image-forming apparatus.

SUMMARY

There are also known developing cartridges each including a memory and an electrical contact surface. The memory may be an integrated circuit (IC) chip, for example. When a drum cartridge to which such a developing cartridge is attached is attached to an image-forming apparatus, the electrical contact surface is in contact with an electrical terminal provided in the image-forming apparatus. However, the electrical contact surface may be rubbed against a part of the image-forming apparatus during attachment and detachment of the drum cartridge (including the developing cartridge) relative to the image-forming apparatus.

In view of the foregoing, it is an object of the present disclosure to provide a developing cartridge capable of reducing rubbing of an electrical contact surface.

In order to attain the above and other objects, according to one aspect, the present disclosure provides a developing cartridge including a housing, a developing roller, a memory, a holder, and a relay component. The housing is configured to accommodate developing agent therein and extends in a first direction. The developing roller is rotatable about a first axis extending in the first direction. The developing roller is positioned at one end portion of the housing in a second direction. The memory is held at the housing. The holder holds an electrical contact surface. The holder is movable relative to the housing in at least one of the second direction and a third direction crossing the first direction and the second direction, the third direction crossing the electrical contact surface. The relay component electrically connects the memory to the electrical contact surface.

DETAILED DESCRIPTION

Figure 1:
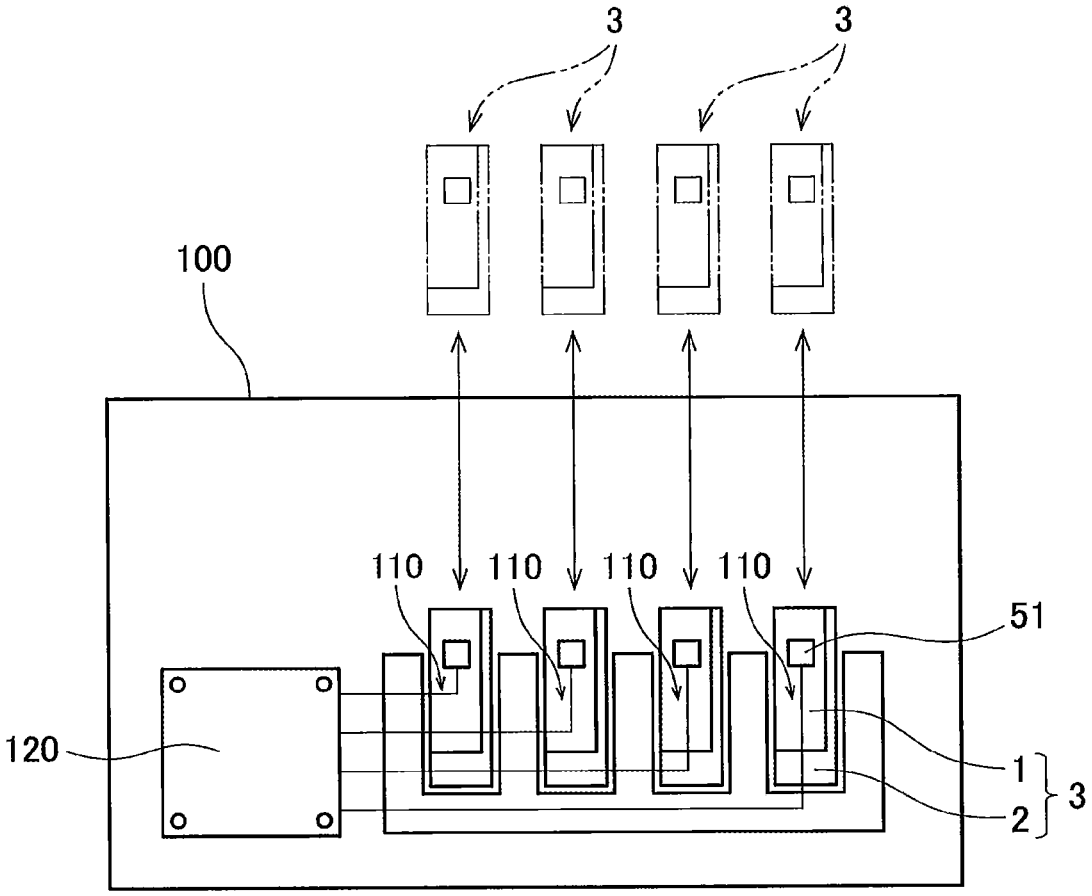
FIG. 1 is a conceptual diagram of an image-forming apparatus to which a developing cartridge according to an embodiment is attachable.

Hereinafter, one embodiment of the disclosure will be described while referring to FIGS. 1 through 8.

In the following description, referring to FIG. 2, the term "first direction" refers to a direction in which a casing 10 of a developing cartridge 1 of the embodiment extends in a state where a process cartridge 3 is attached to an image-forming apparatus 100. The term "second direction" refers to a direction in which an agitator 20 and a developing roller 30 of the developing cartridge 1 are arranged. The term "third direction" refers to a direction crossing electrical contact surfaces 71 of the developing cartridge 1. The first direction and the second direction cross each other (preferably, orthogonal to each other). The second direction and the third direction cross each other (preferably, orthogonal to each other). The third direction and the first direction cross each other (preferably, orthogonal to each other).

1. Configuration of Image-Forming Apparatus

FIG. 1 is a conceptual diagram of the image-forming apparatus 100. The image-forming apparatus 100 according to the embodiment is an electrophotographic-type printer. For example, the image-forming apparatus 100 may be a laser printer or an LED printer.

The image-forming apparatus 100 includes four process cartridges 3. Each of the four process cartridges 3 includes a developing cartridge 1 and a drum cartridge 2. Each developing cartridge 1 is attachable to a corresponding one of the drum cartridges 2. The four developing cartridges 1 store respective developing agents of different colors such as cyan, magenta, yellow, and black.

The image-forming apparatus 100 includes four cartridge holders 110. Each of the process cartridges 3 is attachable to and detachable from a corresponding one of the cartridge holders 110. The image-forming apparatus 100 is configured to form images on recording surfaces of sheets using the developing agents, such as toner, supplied from the developing cartridges 1. The number of the process cartridges 3 attachable to the image-forming apparatus 100 may be one, two or three, or may be five or more.

Each of the four developing cartridges 1 includes a memory 51. The memory 51 is a storage medium capable of reading and writing information. The image-forming apparatus 100 also includes a controller 120. When the process cartridges 3 are attached to the corresponding cartridge holders 110, the memory 51 of each developing cartridge 1 is electrically connected to the controller 120. The controller 120 may be a circuit board, for example. The controller 120 includes a processor such as a central processing unit (CPU), and various memories. The controller 120 is configured to execute various processes for the image-forming apparatus 100 as the processor operates according to programs stored in the memories.

2. Process Cartridge

Figure 2:
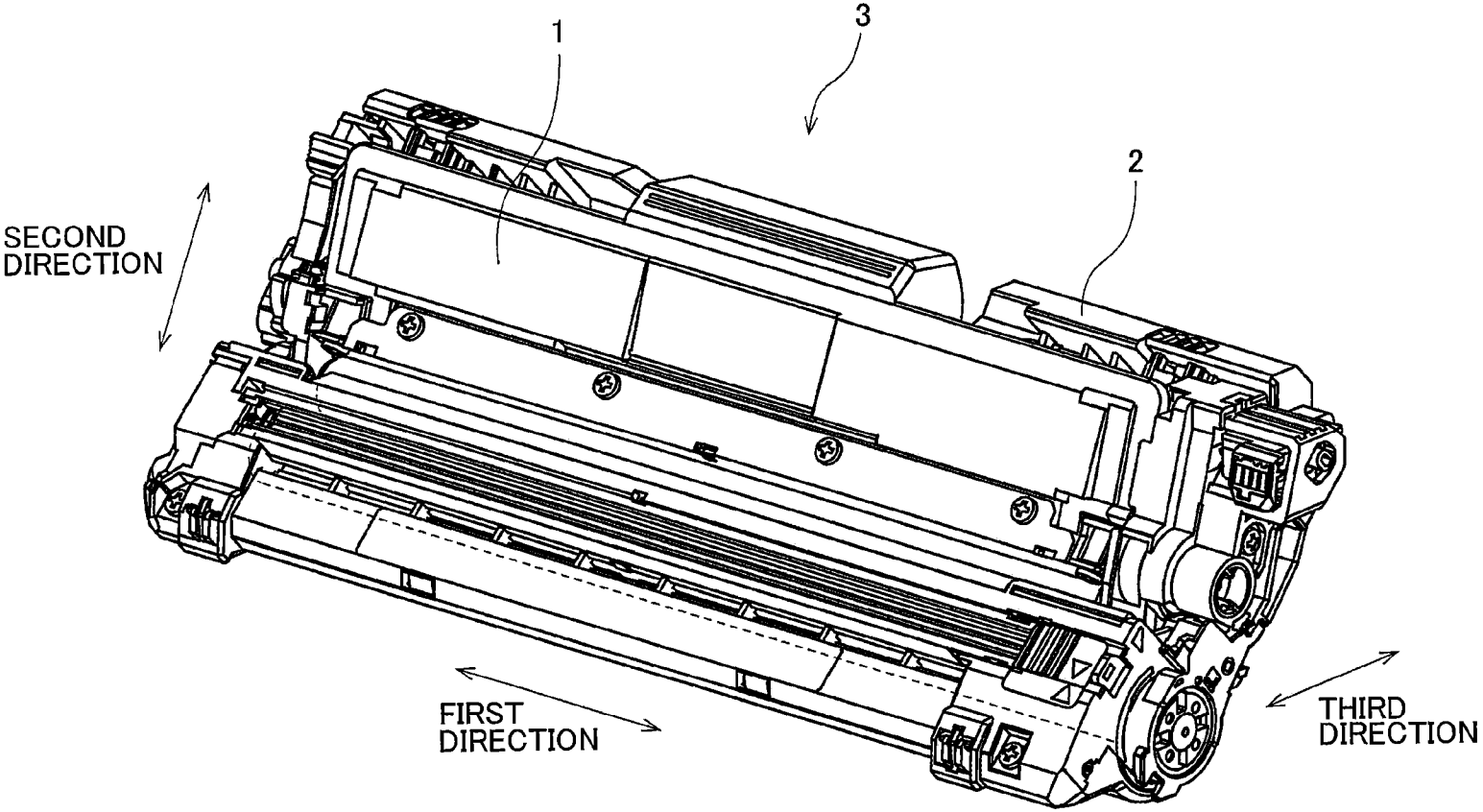
FIG. 2 is a perspective view of a process cartridge including the developing cartridge according to the embodiment and a drum cartridge.

FIG. 2 is a perspective view of the process cartridge 3. As described above, the process cartridge 3 includes the developing cartridge 1 and the drum cartridge 2. The developing cartridge 1 is attachable to and detachable from the drum cartridge 2.

2-1. Developing Cartridge

Figure 3:
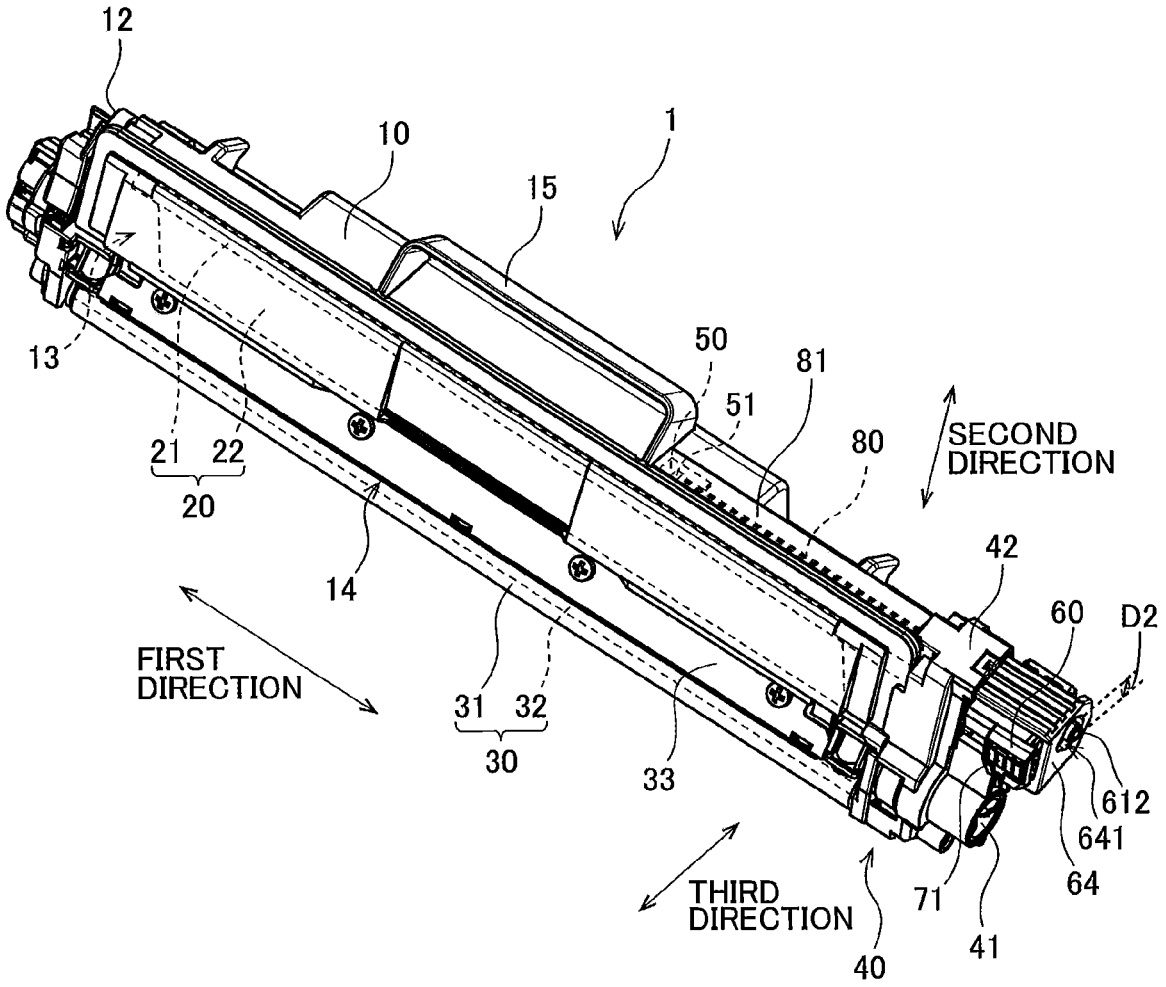
FIG. 3 is a perspective view of the developing cartridge according to the embodiment.
Figure 4:
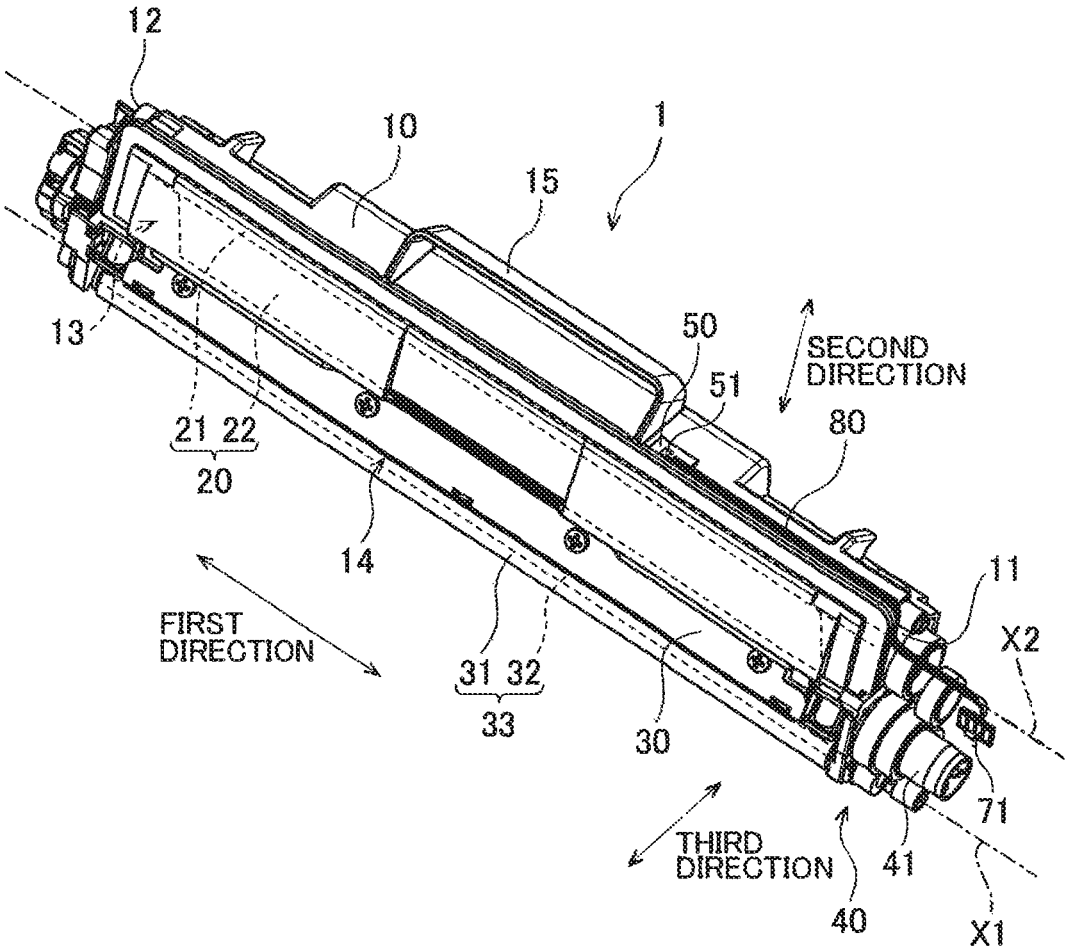
FIG. 4 is a perspective view of the developing cartridge according to the embodiment without a gear cover, a holder cover, and a memory cover.

FIG. 3 is a perspective view of the developing cartridge 1. FIG. 4 is a perspective view of the developing cartridge 1 without a gear cover 42, a holder 60, a holder cover 64, and a memory cover 81 (described later). As illustrated in FIGS. 3 and 4, the developing cartridge 1 includes the casing 10, the agitator 20, the developing roller 30, a gear unit 40, a main board 50, the holder 60, the electrical contact surfaces 71, and a harness 80.

The casing 10 is configured to store a developing agent. The casing 10 extends in the first direction. The casing 10 has a first outer surface 11 and a second outer surface 12 spaced away from each other in the first direction. The casing 10 extends in the first direction between the first outer surface 11 and the second outer surface 12. That is, the first outer surface 11 is at one end portion of the casing 10 in the first direction, while the second outer surface 12 is at another end portion of the casing 10 in the first direction. The gear unit 40 and the holder 60 are positioned at the first outer surface 11. A storage chamber 13 is defined inside the casing 10 for storing the developing agent therein.

The casing 10 has an opening 14. The opening 14 is positioned at one end portion of the casing 10 in the second direction. The opening 14 provides communication between the storage chamber 13 and the outside of the casing 10. The casing 10 also includes a handle 15. The handle 15 is positioned on an outer surface of another end portion of the casing 10 in the second direction.

The agitator 20 includes an agitator shaft 21 and a blade 22. The agitator shaft 21 extends in the first direction and defines a rotation axis X2 (second axis) extending in the first direction. The blade 22 extends from the agitator shaft 21 toward an inner surface of the casing 10. The blade 22 and part of the agitator shaft 21 are positioned within the storage chamber 13 of the casing 10. One end portion of the agitator shaft 21 in the first direction is fixed to an agitator gear belonging to the gear unit 40. The agitator shaft 21 is incapable of rotating relative to the agitator gear. In accordance with rotation of the agitator gear, the agitator shaft 21 and the blade 22 are rotatable about the rotation axis X2 (second axis) extending in the first direction. The rotation of the blade 22 can agitate the developing agent stored in the storage chamber 13.

The developing roller 30 is positioned at the opening 14 of the casing 10. That is, the developing roller 30 is positioned at the one end portion of the casing 10 in the second direction. The developing roller 30 is rotatable about a rotation axis X1 (first axis) extending in the first direction. The developing roller 30 according to this embodiment includes a roller body 31 and a roller shaft 32. The roller body 31 is a hollow-cylindrical member extending in the first direction. The roller body 31 is made from an elastic rubber, for example. The roller shaft 32 is a solid-cylindrical member penetrating the roller body 31 in the first direction. The roller shaft 32 is made from metal or electrically conductive resin.

The roller body 31 is fixed to the roller shaft 32 so as not to rotate relative to the roller shaft 32. One end portion of the roller shaft 32 in the first direction is fixed to a developing-roller gear belonging to the gear unit 40. The roller shaft 32 is thus incapable of rotating relative to the developing-roller gear. As the developing-roller gear rotates, the roller shaft 32 also rotates, causing the roller body 31 to rotate together with the roller shaft 32.

Note that the roller shaft 32 does not necessarily penetrate through the roller body 31 in the first direction. For example, the roller shaft 32 may be configured as a pair of roller shafts extending in the first direction. In this case, one of the roller shafts may be provided at one end of the roller body 31 in the first direction, while the other roller shaft may be provided at another end of the roller body 31 in the first direction.

The developing cartridge 1 also includes a supply roller (not illustrated). The supply roller is positioned between the developing roller 30 and the storage chamber 13. The supply roller is rotatable about a rotation axis extending in the first direction. Upon receipt of a driving force into the developing cartridge 1, the developing agent in the storage chamber 13 is supplied therefrom to an outer peripheral surface of the developing roller 30 through the supply roller. While being supplied from the supply roller to the developing roller 30, the developing agent is triboelectrically charged between the supply roller and the developing roller 30. Since a bias voltage is applied to the roller shaft 32 of the developing roller 30, the developing agent is attracted to an outer peripheral surface of the roller body 31 by an electrostatic force between the roller shaft 32 and the developing agent.

The developing cartridge 1 also includes a thickness-regulating blade 33. The thickness-regulating blade 33 is configured to level the developing agent supplied onto the outer peripheral surface of the roller body 31 into a uniform thickness. The developing agent on the outer peripheral surface of the roller body 31 is then supplied to a corresponding photosensitive drum 92 (described later) of the drum cartridge 2. At this time, the developing agent moves from the roller body 31 to the photosensitive drum 92 based on an electrostatic latent image formed on an outer peripheral surface of the photosensitive drum 92. The electrostatic latent image is thus developed into a visible toner image on the outer peripheral surface of the photosensitive drum 92.

The gear unit 40 is positioned at the first outer surface 11 of the casing 10. The gear unit 40 includes: a plurality of gears including the agitator gear and the developing-roller gear described above; a coupling 41; and the gear cover 42. Together with the casing 10, the gear cover 42 constitutes a housing of the developing cartridge 1. The gear cover 42 is fixed to the first outer surface 11 of the casing 10 with screws, for example. At least part of the plurality of gears is positioned between the first outer surface 11 and the gear cover 42. That is, at least part of the plurality of gears is covered by the gear cover 42. The coupling 41 is exposed to the outside of the gear cover 42. When the process cartridge 3 is attached to the image-forming apparatus 100, a drive shaft of the image-forming apparatus 100 is connected to the coupling 41. Hence, as the drive shaft rotates, the rotation of the drive shaft is transmitted, through the coupling 41, to the plurality of gears including the agitator gear and developing-roller gear.

The plurality of gears of the gear unit 40 may transmit torque by meshing engagement between gear teeth or by frictional force between neighboring gears.

The main board 50 is a circuit board held by the casing 10. The main board 50 includes the memory 51. The memory 51 is a storage medium capable of storing various information on the developing cartridge 1. For example, an IC chip may be employed as the memory 51. In this embodiment, the main board 50 is positioned on the outer surface of the other end of the casing 10 in the second direction. Specifically, the main board 50 is positioned between the handle 15 and the one end portion of the casing 10 in the first direction (i.e., the first outer surface 11). The main board 50 is fixed to the outer surface of the casing 10 with an adhesive, for example.

Figure 5:
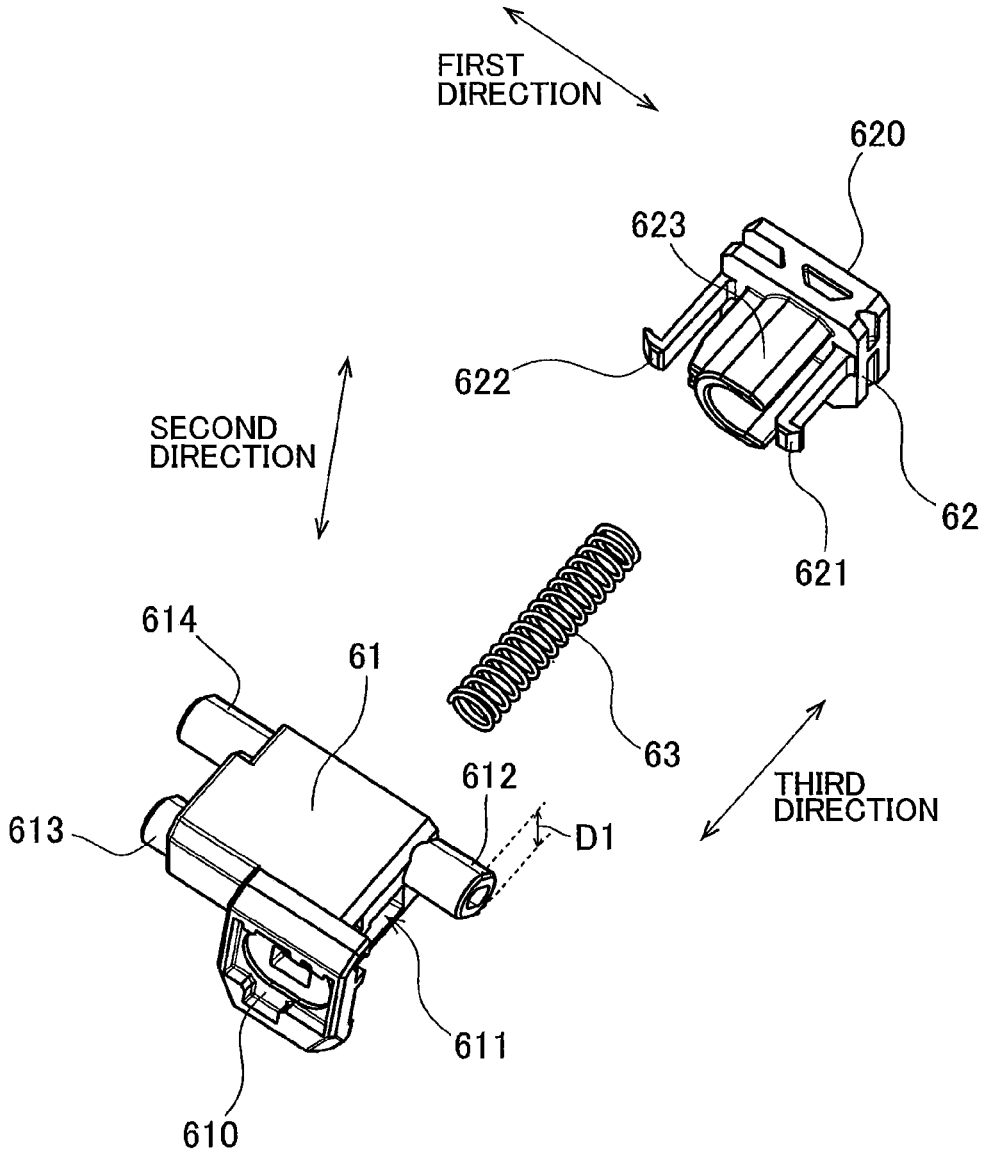
FIG. 5 is an exploded perspective view of a holder of the developing cartridge according to the embodiment.
Figure 6:
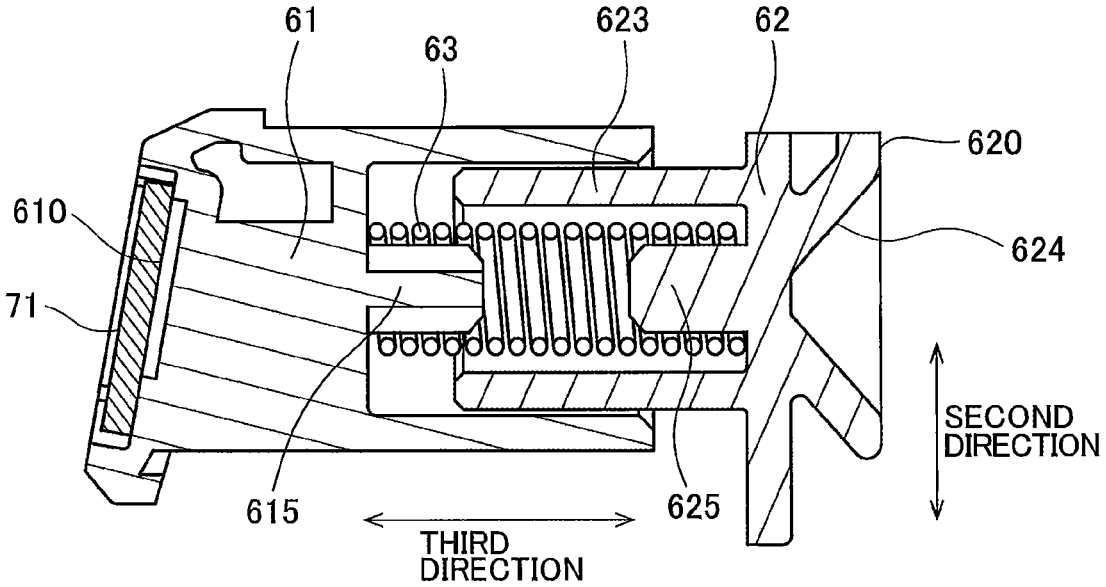
FIG. 6 is a cross-sectional view of the holder of the developing cartridge according to the embodiment taken along a plane orthogonal to a first direction, wherein a coil spring of the holder is in a first state.
Figure 7:
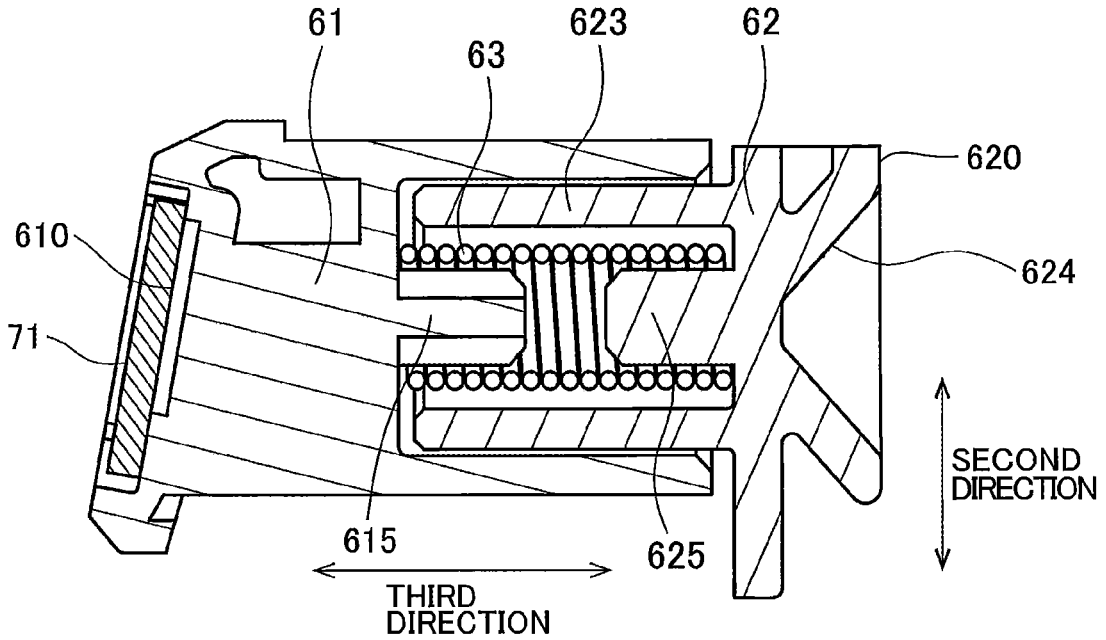
FIG. 7 is a cross-sectional view of the holder of the developing cartridge according to the embodiment taken along the plane orthogonal to the first direction, wherein the coil spring of the holder is in a second state.

The holder 60 is positioned at the one end portion of the casing 10 in the first direction. FIG. 5 is an exploded perspective view of the holder 60. FIGS. 6 and 7 are cross-sectional views of the holder 60 taken along a plane perpendicular to the first direction. As illustrated in FIGS. 5 to 7, the holder 60 includes a first holder member 61, a second holder member 62, and a coil spring 63.

The first holder member 61 includes a first-holder outer surface 610. The second holder member 62 includes a second-holder outer surface 620. In an assembled state of the holder 60, the first-holder outer surface 610 and the second-holder outer surface 620 are spaced away from each other in the third direction. The first-holder outer surface 610 (first end) is located at one end portion of the holder 60 in the third direction. The second-holder outer surface 620 (second end) is located at another end portion of the holder 60 in the third direction.

The coil spring 63 is a resilient member configured to expand and contract in the third direction. The coil spring 63 connects the first holder member 61 to the second holder member 62. The coil spring 63 is positioned between the first-holder outer surface 610 and the second-holder outer surface 620 in the third direction. The coil spring 63 may be connected to each of the first-holder outer surface 610 and the second-holder outer surface 620 either directly or indirectly through other members. The coil spring 63 is configured to expand and contract in the third direction between a first state (illustrated in FIG. 6) and a second state (illustrated in FIG. 7).

The coil spring 63 has a length in the third direction in the first state (hereinafter referred to as "first length") that is longer than a length of the coil spring 63 in the third direction in the second state (hereinafter referred to as "second length"). A distance between the first-holder outer surface 610 and the second-holder outer surface 620 in the third direction when the coil spring 63 has the first length (in the first state) is greater than a distance between the first-holder outer surface 610 and the second-holder outer surface 620 in the third direction when the coil spring 63 has the second length (in the second state). At least, the second length is shorter than a natural length of the coil spring 63.

The first holder member 61 includes a protrusion 615. The protrusion 615 protrudes from an inner surface of the first holder member 61 facing the second holder member 62 in the third direction. The protrusion 615 protrudes toward the second holder member 62 (inward) in the third direction.

The second holder member 62 includes a spring holder 623 of a hollow-cylindrical shape. The spring holder 623 protrudes from an inner surface of the second holder member 62 facing the first holder member 61 in the third direction. The spring holder 623 protrudes toward the first holder member 61 (outward) in the third direction. The second holder member 62 also includes a columnar-shaped protrusion 625 positioned inside the spring holder 623. Part of the coil spring 63 is inserted in the spring holder 623. Specifically, one end portion of the coil spring 63 in the third direction is received by the protrusion 615, while another end portion of the coil spring 63 in the third direction is received by the protrusion 625 within the spring holder 623. With this structure, the first holder member 61 (first-holder outer surface 610) is movable relative to the second holder member 62 (second-holder outer surface 620) in the third direction.

The second holder member 62 includes a first claw 621 and a second claw 622. The first claw 621 and the second claw 622 extend from the inner surface of the second holder member 62 toward the first holder member 61 in the third direction. Each of the first claw 621 and the second claw 622 has a distal end portion protruding in a direction crossing the third direction. Specifically, the distal end portion of the first claw 621 protrudes outward in the third direction, while the distal end portion of the second claw 622 protrudes inward in the third direction (toward the gear cover 42). The first holder member 61 includes a first opening 611 and a second opening (not illustrated). The distal end portion of the first claw 621 is inserted into the first opening 611. The distal end portion of the second claw 622 is inserted into the non-illustrated second opening.

When the coil spring 63 is in the first state, the distal end portion of the first claw 621 is in contact with the first holder member 61 at an edge of the first opening 611 closest to the second-holder outer surface 620 in the third direction. Likewise, when the coil spring 63 is in the first state, the distal end portion of the second claw 622 is in contact with the first holder member 61 at an edge of the second opening closest to the second-holder outer surface 620 in the third direction. This contact between the second holder member 62 (first claw 621 and second claw 622) and the first holder member 61 (first opening 611 and second opening) prevents the coil spring 63 from expanding more than the first state in the third direction. Further, this structure prevents the first holder member 61 and the second holder member 62 from disengaging from each other. When the coil spring 63 is in the second state, the distal end portion of the first claw 621 is separated from the edge of the first opening 611 closest to the second-holder outer surface 620 in the third direction. Likewise, when the coil spring 63 is in the second state, the distal end portion of the second claw 622 is separated from the edge of the second opening closest to the second-holder outer surface 620 in the third direction.

Instead of the first opening 611, a recess or a step may be provided in the first holder member 61 to contact the first claw 621. Instead of the second opening, a recess or a step may be provided in the first holder member 61 to contact the second claw 622. Alternatively, claws may be provided in the first holder member 61, while openings, recesses, or steps may be provided in the second holder member 62.

As illustrated in FIG. 3, the developing cartridge 1 also includes the holder cover 64. The holder cover 64 is positioned at the one end portion of the casing 10 in the first direction. Specifically, the holder cover 64 is positioned opposite to the casing 10 with respect to the gear cover 42 in the first direction. The holder cover 64 is fixed to an outer end face of the gear cover 42 in the first direction. The holder cover 64 covers at least part of the holder 60.

Specifically, with regard to the holder 60, the first holder member 61 includes a first boss 612, a second boss 613, and a third boss 614. The first boss 612 is provided on a surface of the first holder member 61 facing the holder cover 64 in the first direction. The first boss 612 extends toward the holder cover 64 in the first direction. The second boss 613 and the third boss 614 are provided on a surface of the first holder member 61 facing the gear cover 42 in the first direction. The second boss 613 and the third boss 614 extend toward the gear cover 42 in the first direction.

The holder cover 64 includes a first through-hole 641. The first through-hole 641 penetrates through an outer end wall of the holder cover 64 in the first direction. The first boss 612 of the first holder member 61 is inserted into the first through-hole 641.

The gear cover 42 includes a second through-hole and a third through-hole (both not illustrated). The second through-hole and the third through-hole penetrate through an outer end wall of the gear cover 42 in the first direction. The second boss 613 of the first holder member 61 is inserted into the second through-hole. The third boss 614 of the first holder member 61 is inserted into the third through-hole.

The first through-hole 641 has a dimension (internal dimension) D2 in the second direction that is greater than a dimension (external dimension) D1 of the first boss 612 in the second direction. The second through-hole has a dimension (internal dimension) in the second direction that is greater than a dimension (external dimension) of the second boss 613 in the second direction. The third through-hole has a dimension (internal dimension) in the second direction that is greater than a dimension (external dimension) of the third boss 614 in the second direction. With this structure, the holder 60 is movable relative to the gear cover 42 and the holder cover 64 in the second direction, together with the first boss 612, the second boss 613 and the third boss 614. As the holder 60 moves in the second direction, the electrical contact surfaces 71 (described later) also move together with the holder 60 in the second direction.

The first through-hole 641 has a dimension (internal dimension) in the third direction that is greater than a dimension (external dimension) of the first boss 612 in the third direction. The second through-hole has a dimension (internal dimension) in the third direction that is greater than a dimension (external dimension) of the second boss 613 in the third direction. The third through-hole has a dimension (internal dimension) in the third direction that is greater than a dimension (external dimension) of the third boss 614 in the third direction. With this structure, the holder 60 is movable relative to the gear cover 42 and the holder cover 64 in the third direction, together with the first boss 612, the second boss 613 and the third boss 614. As the holder 60 moves in the third direction, the electrical contact surfaces 71 (described later) also move together with the holder 60 in the third direction.

Incidentally, the holder cover 64 may include a first recess, instead of the first through-hole 641, for receiving the first boss 612 in the first recess. The gear cover 42 may include a second recess, instead of the second through-hole, for receiving the second boss 613 in the second recess. The gear cover 42 may include a third recess, instead of the third through-hole, for receiving the third boss 614 in the third recess. Alternatively, the holder cover 64 may include a boss, while the first holder member 61 may include a through-hole or a recess in which the boss of the holder cover 64 is inserted. The gear cover 42 may include bosses, while the first holder member 61 may include through-holes or recesses in which the bosses are inserted.

That is, either one of the holder 60 and the housing (configured of the casing 10, the gear cover 42 and the holder cover 64) may include bosses, while the other one of the holder 60 and the housing may include through-holes or recesses in which the bosses are inserted.

The electrical contact surfaces 71 are electrically-conductive surfaces held by the holder 60. The electrical contact surfaces 71 are positioned at the first-holder outer surface 610 of the first holder member 61. Specifically, the electrical contact surfaces 71 are positioned in a recess formed on the first-holder outer surface 610. The electrical contact surfaces 71 are fixed to the first-holder outer surface 610 directly or indirectly through other member(s). As the holder 60 moves relative to the casing 10, the electrical contact surfaces 71 also move together with the holder 60 relative to the casing 10. As the first holder member 61 moves relative to the second holder member 62 in the third direction, the electrical contact surfaces 71 also move together with the first holder member 61 relative to the second holder member 62 in the third direction.

In the present embodiment, four of the electrical contact surfaces 71 are held by the first-holder outer surface 610. Each of the electrical contact surfaces 71 is made from an electrically-conductive metal. The number of electrical contact surfaces 71 held by the holder 60 may be one, two, or three, or may be five or more.

The harness 80 is a flexible and deformable relay component including a plurality of electrically conductive wires. As illustrated in FIG. 4, the harness 80 has one end portion connected to the main board 50. The harness 80 extends from the main board 50 in the first direction along the outer surface of the other end portion of the casing 10 in the second direction. The harness 80 extends inside the gear cover 42 and extends into the holder 60, whereby another end portion of the harness 80 is connected to the respective electrical contact surfaces 71. The memory 51 of the main board 50 is thus electrically connected to the electrical contact surfaces 71 through the electrically conductive wires included in the harness 80.

The developing cartridge 1 according to the embodiment also includes the memory cover 81. The memory cover 81 is fixed to the outer surface of the other end of the casing 10 in the second direction with, for example, screws or an adhesive. As illustrated in FIGS. 3 and 4, the main board 50 and at least part of the harness 80 are covered by the memory cover 81. That is, the main board 50 and at least part of the harness 80 are mounted between the memory cover 81 and the outer surface of the other end of the casing 10 in the second direction. This structure can prevent the user from touching the main board 50 and the harness 80.

As described above, in the developing cartridge 1, the electrical contact surfaces 71 are held by the holder 60, while the memory 51 of the main board 50 is not held by the holder 60 but by the casing 10. The configuration of the embodiment can provide freedom in design of the holder 60 irrespective of the shape and size of the memory 51, thereby contributing to easy downsizing of the holder 60.

2-2. Drum Cartridge

Figure 8:
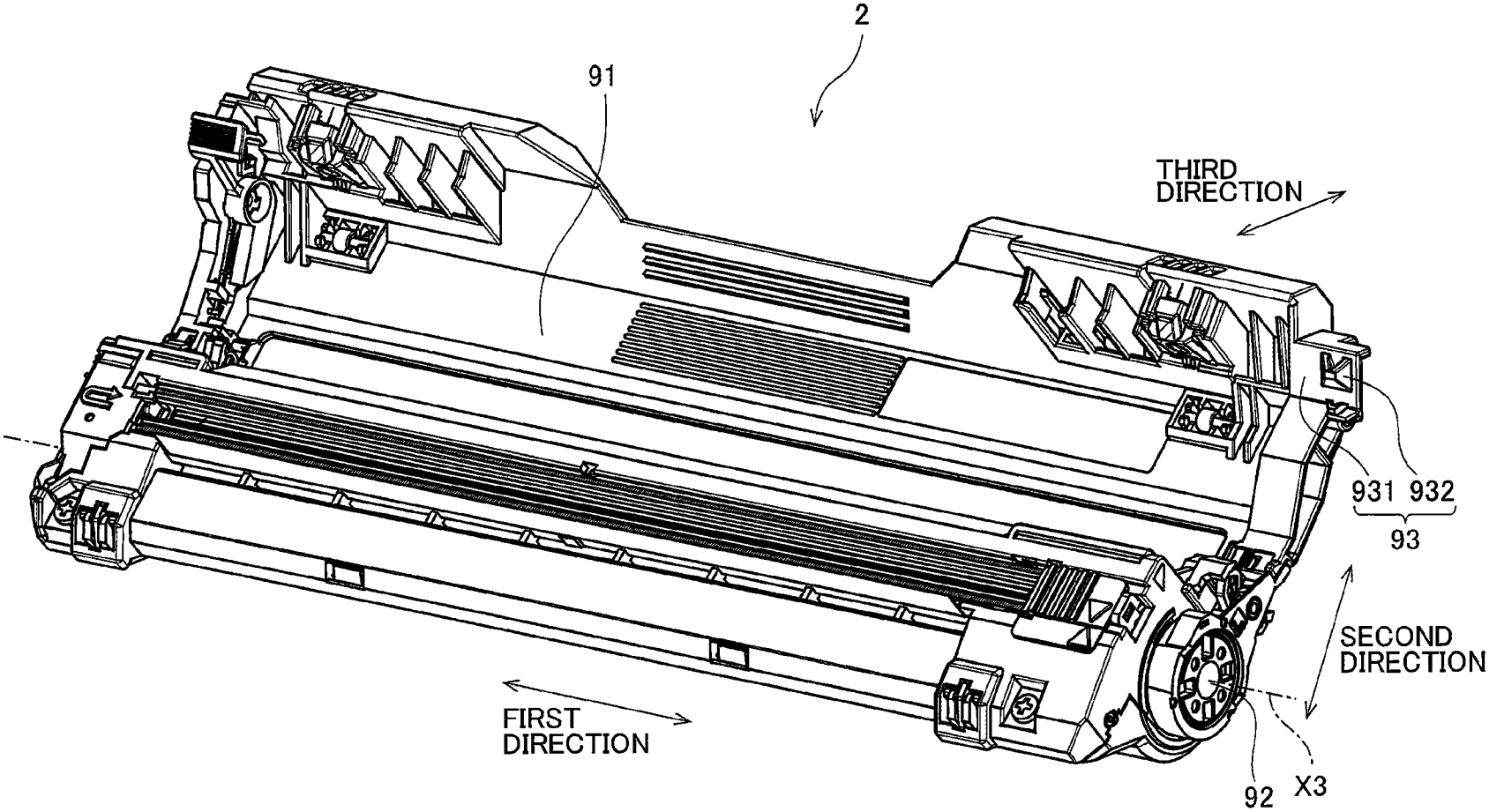
FIG. 8 is a perspective view of the drum cartridge to which the developing cartridge according to the embodiment is attachable.

FIG. 8 is a perspective view of the drum cartridge 2. As illustrated in FIG. 8, the drum cartridge 2 includes a developing-cartridge holder 91 and the photosensitive drum 92. The developing cartridge 1 is attachable to and detachable from the developing-cartridge holder 91. The photosensitive drum 92 is rotatable about a rotation axis X3 extending in the first direction. The photosensitive drum 92 is positioned at one end portion of the drum cartridge 2 in the second direction. In a state where the developing cartridge 1 is attached to the developing-cartridge holder 91, the outer peripheral surface of the developing roller 30 is in contact with the outer peripheral surface of the photosensitive drum 92.

The developing-cartridge holder 91 includes a holding plate 93. The holding plate 93 is positioned at one end portion of the developing-cartridge holder 91 in the first direction. In a state where the developing cartridge 1 is attached to the drum cartridge 2, the second-holder outer surface 620 of the holder 60 faces the holding plate 93 in the third direction. As illustrated in FIG. 8, the holding plate 93 includes a holding surface 931 and a protrusion 932. The holding surface 931 extends in the first direction and the second direction. The protrusion 932 protrudes in the third direction from the holding surface 931 toward the holder 60 of the developing cartridge 1 attached to the developing-cartridge holder 91. The protrusion 932 according to this embodiment has a substantially square pyramid shape that is tapered as extending away from the holding surface 931.

As illustrated in FIGS. 6 and 7, the second holder member 62 includes a recess 624 formed in the second-holder outer surface 620. The recess 624 has a substantially square pyramid shape that is tapered toward the first holder member 61. When the developing cartridge 1 is attached to the drum cartridge 2, the protrusion 932 of the holding plate 93 is fitted into the recess 624 of the second holder member 62, and the holding plate 93 comes into contact with the second-holder outer surface 620. The holder 60 is thus supported relative to the drum cartridge 2.

The image-forming apparatus 100 includes a main-body terminal (not illustrated). The main-body terminal is made from electrically conductive metal. When the process cartridge 3 configured of the developing cartridge 1 and the drum cartridge 2 is attached to the image-forming apparatus 100, the holder 60 is sandwiched between the main-body terminal and the holding plate 93, and the electrical contact surfaces 71 are in contact with the main-body terminal. The controller 120 of the image-forming apparatus 100 is thus electrically connected to the memory 51 of the main board 50 through the main-body terminal, the electrical contact surfaces 71, and the harness 80. The controller 120 is allowed to retrieve and write information from and on the memory 51.

While the process cartridge 3 is attached to or detached from the image-forming apparatus 100, the holder 60 is movable in the second direction and/or the third direction relative to the casing 10, the gear cover 42, and the holder cover 64. That is, the position of the electrical contact surfaces 71 can be varied in the second direction and/or the third direction according to the shape of the cartridge holder 110. As a result, the electrical contact surfaces 71 are less likely to be rubbed against members of the image-forming apparatus 100.

When the process cartridge 3 is attached to the image-forming apparatus 100, the coil spring 63 changes into the second state from the first state. That is, the length of the coil spring 63 in the third direction becomes the second length shorter than the first length. Since the coil spring 63 is compressed in the second state, friction of the electrical contact surfaces 71 against the main-body terminal can be reduced. Moreover, since the electrical contact surfaces 71 are pressed against the main-body terminal due to a restoring force of the compressed coil spring 63, electrical connection between the main-body terminal and the electrical contact surfaces 71 can be stabilized.

The dimension of the recess 624 in the second direction (depth) is greater than the dimension of the protrusion 932 in the second direction. Therefore, even in a state where the developing cartridge 1 is attached to the drum cartridge 2, the second-holder outer surface 620 is movable relative to the holding plate 93 in the second direction. When the process cartridge 3 is detached from the image-forming apparatus 100, the holder 60 is caused to move from a first position to a second position in the second direction. More specifically, the holder 60 is caused to pivot in the second direction about the main-body terminal during detachment of the process cartridge 3. In the meantime, the first boss 612 moves in the second direction inside the first through-hole 641 of the holder cover 64; the second boss 613 moves in the second direction inside the second through-hole of the gear cover 42; and the third boss 614 moves in the second direction inside the third through-hole of the gear cover 42. In this manner, pivoting of the holder 60 about the main-body terminal can mitigate rubbing of the electrical contact surfaces 71 against the main-body terminal during detachment of the process cartridge 3 from the image-forming apparatus 100.

3. Modifications

It would be apparent to those skilled in the art that the embodiment described above is merely an example of the present disclosure and modifications and variations may be made therein without departing from the spirit of the disclosure. Hereinafter, various modifications and variations of the embodiment will be described focusing on differences from the embodiment.

3-1. First Modification

Figure 9:
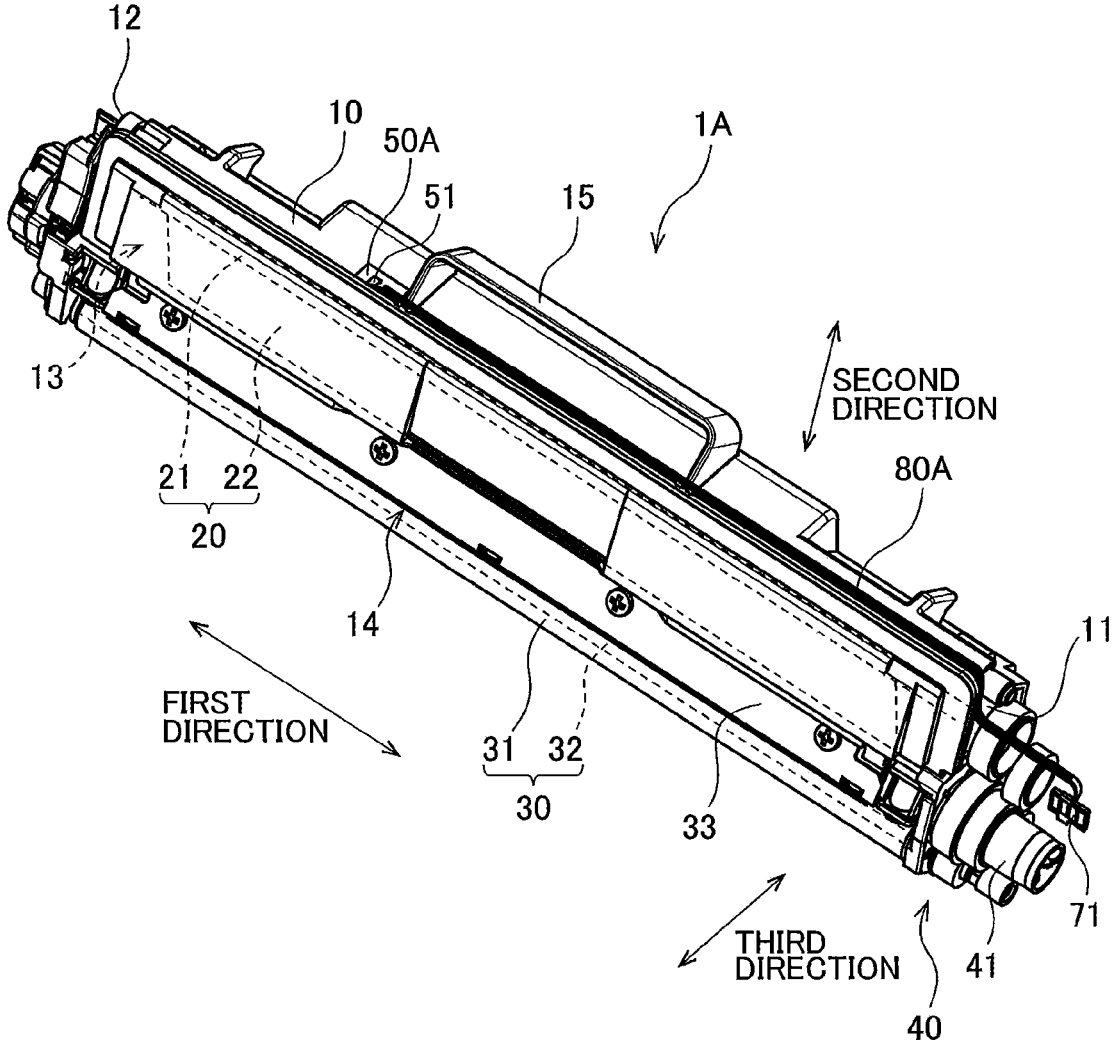
FIG. 9 is a perspective view of a developing cartridge according to a first modification to the embodiment.

FIG. 9 is a perspective view of a developing cartridge 1A according to a first modification to the embodiment. In FIG. 9, the gear cover 42, the holder 60, the holder cover 64, and the memory cover 81 are not illustrated. The developing cartridge 1A of the first modification includes a main board 50A including the memory 51, and a harness 80A connecting the main board 50A to the electrical contact surfaces 71. Similarly to the embodiment described above, the main board 50A including the memory 51 is positioned on the outer surface of the other end of the casing 10 in the second direction. However, the main board 50A is arranged on the outer surface at a position between the handle 15 and the other end of the casing 10 in the first direction. The main board 50A is fixed to the outer surface of the casing 10 with an adhesive, for example. With this structure of the first modification as well, since the memory 51 (main board 50A) is not mounted in the holder 60, the holder 60 can be made compact easily.

Incidentally, the length of the harness 80 of the embodiment can be made shorter than the length of the harness 80A of the first modification. Hence, arrangement of the main board 50 of the embodiment between the handle 15 and the one end portion of the casing 10 in the first direction is preferable, compared to the arrangement of the main board 50A of the first modification.

3-2. Second Modification

Figure 10:
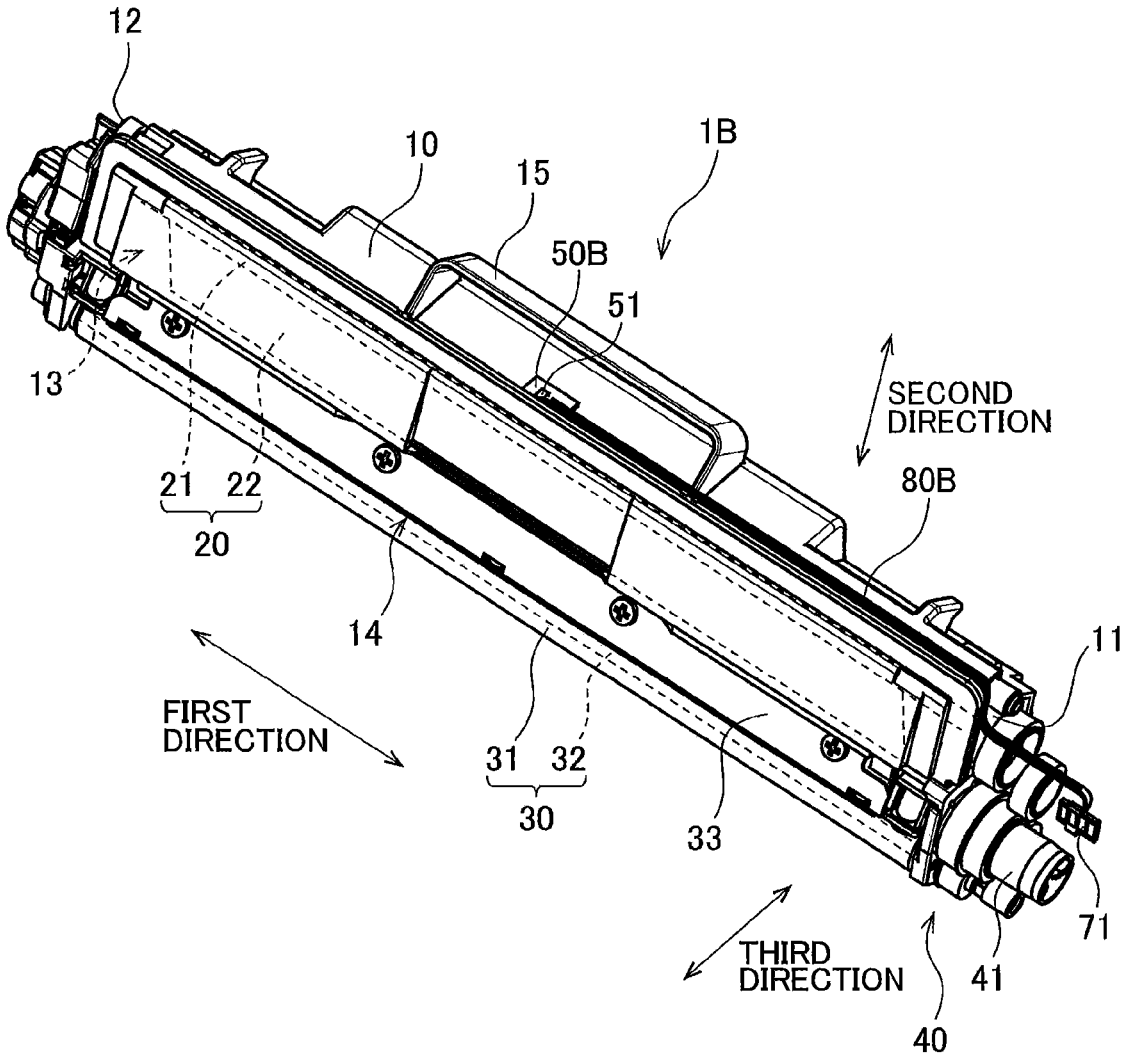
FIG. 10 is a perspective view of a developing cartridge according to a second modification to the embodiment.

FIG. 10 is a perspective view of a developing cartridge 1B according to a second modification to the embodiment. In FIG. 10, the gear cover 42, the holder 60, the holder cover 64, and the memory cover 81 are not illustrated. The developing cartridge 1B of the second modification includes a main board 50B including the memory 51, and a harness 80B connecting the main board 50B to the electrical contact surfaces 71. Similarly to the embodiment described above, the main board 50B including the memory 51 is positioned on the outer surface of the other end of the casing 10 in the second direction. However, in the second modification, the main board 50B is arranged on the outer surface at a position between one end and another end of the handle 15 in the first direction. The main board 50B is fixed to the outer surface of the casing 10 with an adhesive, for example. With this structure of the second modification as well, the holder 60 can be made compact easily, since the memory 51 (main board 50B) is not mounted in the holder 60.

Incidentally, the length of the harness 80 of the embodiment can be made shorter than the length of the harness 80B of the second modification. Hence, arrangement of the main board 50 of the embodiment between the handle 15 and the one end portion of the casing 10 in the first direction is preferable, compared to the arrangement of the main board 50B of the second modification.

3-3. Third Modification

Figure 11:
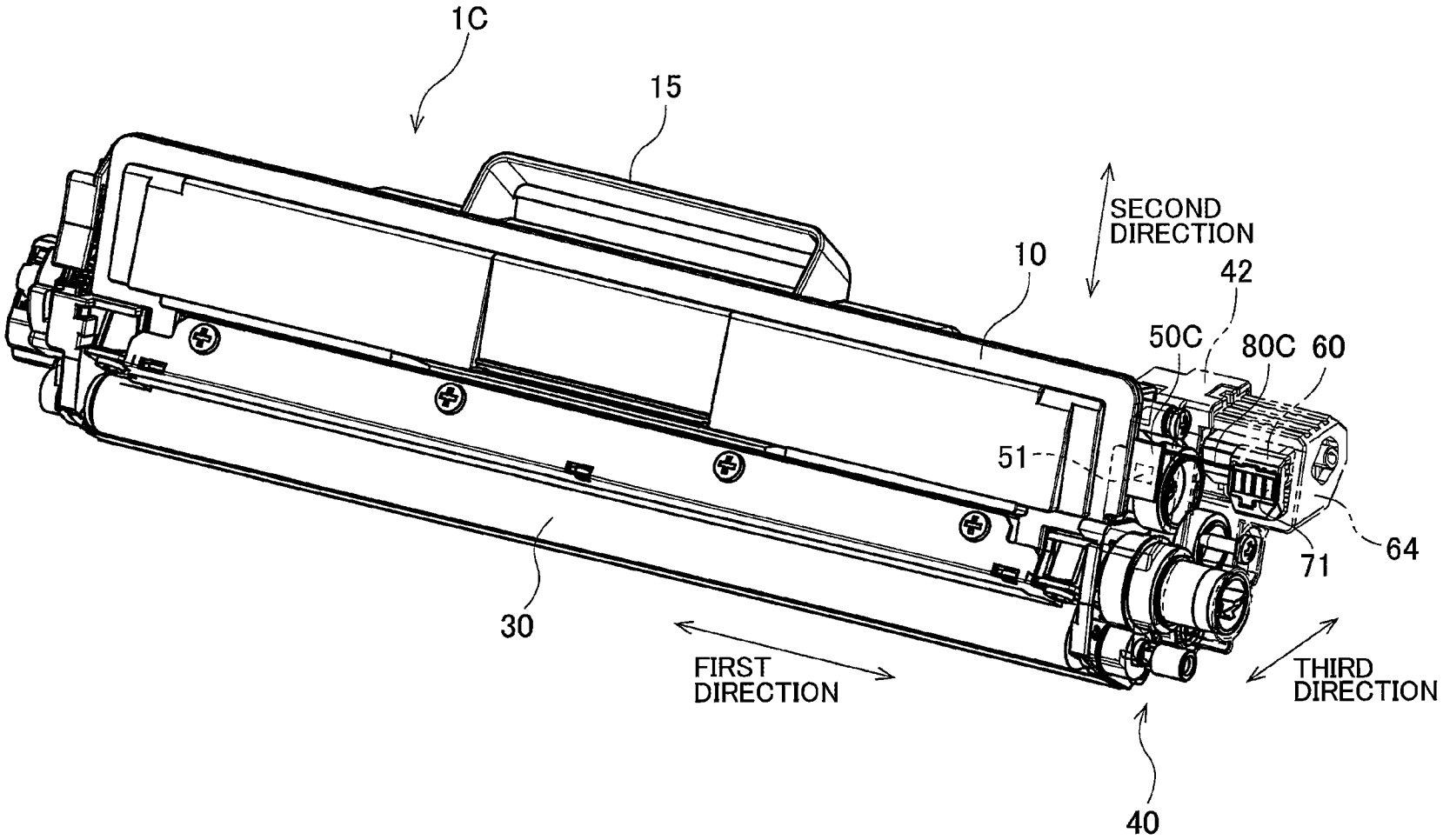
FIG. 11 is a perspective view of a developing cartridge according to a third modification to the embodiment.

FIG. 11 is a perspective view of a developing cartridge 1C according to a third modification to the embodiment. In FIG. 11, the gear cover 42, the holder 60, and the holder cover 64 are indicated by phantom lines. The developing cartridge 1C of the third modification includes a main board 50C including the memory 51, and a harness 80C connecting the main board 50C to the electrical contact surfaces 71. In the third modification, the main board 50C including the memory 51 is positioned between the casing 10 and the gear cover 42. Specifically, the main board 50C is positioned on an inner surface of the gear cover 42. The main board 50C is fixed to the inner surface of the gear cover 42 with an adhesive, for example. With this structure as well, the holder 60 can be made compact easily, since the memory 51 (main board 50C) is not mounted in the holder 60. Moreover, in the third modification, the main board 50C is not exposed to the outside of the developing cartridge 1C. Hence, the user is prevented from touching the memory 51.

3-4. Fourth Modification

Figure 12:
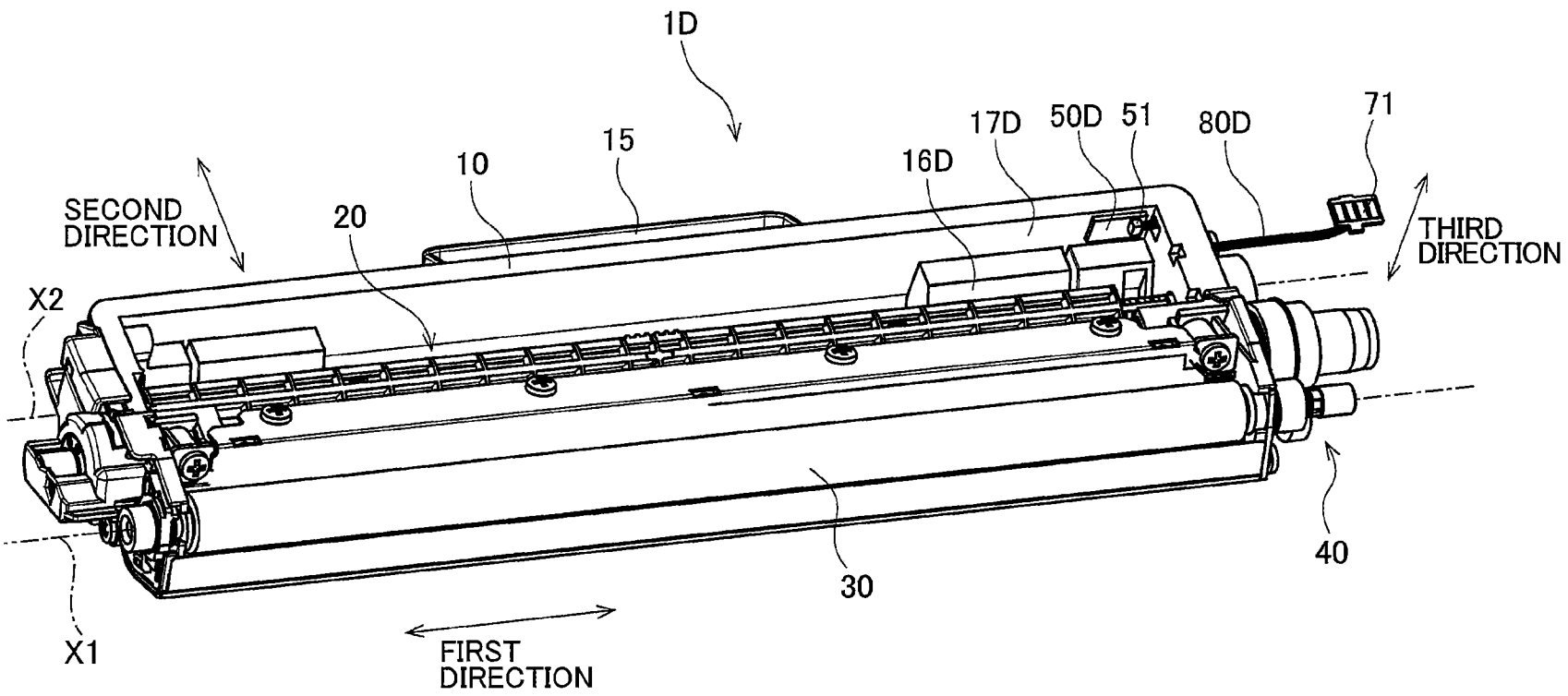
FIG. 12 is a perspective view of a developing cartridge according to a fourth modification to the embodiment.

FIG. 12 is a perspective view of a developing cartridge 1D according to a fourth modification to the embodiment. In FIG. 12, the gear cover 42, the holder 60, and the holder cover 64 are not illustrated. FIG. 12 depicts a state where a panel of the casing 10 is opened, the panel being positioned at one side of the casing 10 in the third direction.

The developing cartridge 1D of the fourth modification includes a main board 50D including the memory 51, and a harness 80D connecting the main board 50D to the electrical contact surfaces 71. In the fourth modification, the main board 50D including the memory 51 is positioned on an inner surface of the casing 10. The main board 50 is fixed to the inner surface of the casing 10 with an adhesive, for example. With this structure as well, the holder 60 can be made compact easily, since the memory 51 (main board 50D) is not mounted in the holder 60. Moreover, the main board 50D is not exposed to the outside of the developing cartridge 1D. Hence, the user is prevented from touching the memory 51.

Specifically, in the fourth modification, the inner surface of the casing 10 includes a first inner surface 16D and a second inner surface 17D. The second inner surface 17D is farther away from the rotation axis X2 (second axis) of the agitator 20 than the first inner surface 16D is from the rotation axis X2. The main board 50 is positioned on the second inner surface 17. Thus, the movement of the blade 22 of the agitator 20 is less likely to be restricted by the main board 50D. Preferably, the main board 50D is positioned outside the rotational locus of the blade 22. However, the main board 50D may be positioned inside the rotational locus of the blade 22, provided that the blade 22 is elastically deformable.

Alternatively, the inner surface of the casing 10 may be formed with a recess. The main board 50D may be disposed in the recess. With this structure, the movement of the blade 22 of the agitator 20 is less likely to be restricted by the main board 50D.

3-5. Other Modifications

In the embodiment described above, the developing cartridge 1 is attachable to a corresponding drum cartridge 2 including one photosensitive drum 2. Alternatively, the developing cartridge of the disclosure may be attachable to a drum unit including a plurality of photosensitive drums. Still alternatively, the developing cartridge of the disclosure may be directly attachable to an image-forming apparatus.

In the embodiment described above, the coil spring 63 is used as an urging member. Alternatively, the urging member of the disclosure may be another type of urging member such as a leaf spring or a torsion spring, instead of the coil spring.

In the embodiment described above, the harness 80 is used as a relay component including the plurality of electrically conductive wires bundled together. Alternatively, a plurality of electrically conductive wires that are not bundled together may be used as the relay component, instead of the harness. Still alternatively, another board may be provided between the main board 50 and the electrical contact surfaces 71.

The detailed structure of the developing cartridge of the disclosure may have shapes different from those shapes illustrated in the attached drawings. Further, the parts and components described in the embodiment and modifications thereto may be combined appropriately, as long as no contradiction is invoked.

REMARKS

The developing cartridges 1, 1A, 1B, 1C and 1D are an example of a developing cartridge. The casing 10 and gear cover 42 are an example of a housing. The developing roller 12 is an example of a developing roller. The rotation axis X1 is an example of a first axis. The memory 51 is an example of a memory. The holder 60 is an example of a holder. The electrical contact surfaces 71 are an example of an electrical contact surface. The harnesses 80, 80A, 80B, 80C and 80D are an example of a relay component. The first-holder outer surface 610 is an example of a first end portion. The second-holder outer surface 620 is an example of a second end portion. The casing 10 is an example of a casing. The holder cover 64 is an example of a holder cover. The gear cover 42 is an example of a gear cover. The handle 15 is an example of a handle. The first inner surface 16D is an example of a first inner surface. The second inner surface 17D is an example of a second inner surface. The agitator 20 is an example of an agitator. The agitator shaft 21 is an example of an agitator shaft. The blade 22 is an example of a blade. The rotation axis X2 is an example of a second axis. The memory cover 81 is an example of a memory cover.

What is claimed is:

1. A developing cartridge comprising:

a housing configured to accommodate developing agent therein, the housing extending in a first direction;

a developing roller rotatable about a first axis extending in the first direction, the developing roller being positioned at one end portion of the housing in a second direction;

a memory held at the housing;

a holder holding an electrical contact surface and movable relative to the housing in at least one of the second direction and a third direction crossing the first direction and the second direction, the third direction crossing the electrical contact surface; and a relay component electrically connecting the memory to the electrical contact surface.

2. The developing cartridge according to claim 1, wherein the electrical contact surface is positioned at one end portion of the holder in the third direction.

3. The developing cartridge according to claim 2, wherein the holder has a first end portion in the third direction and a second end portion positioned away from the first end portion in the third direction, the first end portion holding the electrical contact surface, the first end portion being movable in the third direction relative to the second end portion.

4. The developing cartridge according to claim 3, further comprising a resilient member positioned between the first end portion and the second end portion, the resilient member being configured to expand and contract in the third direction between a first state and a second state, a length of the resilient member in the third direction being greater in the first state than in the second state.

5. The developing cartridge according to claim 1, wherein the memory is fixed to the housing.

6. The developing cartridge according to claim 1, wherein the memory is positioned at an outer surface of the housing.

7. The developing cartridge according to claim 1, wherein the relay component is a harness including a plurality of electrically conductive wires.

* * * * *